US005450693A

United States Patent [19]

Tarrega

[11] Patent Number: 5,450,693

[45] Date of Patent: Sep. 19, 1995

[54] MECHANISM FOR SLIDING GLASS DOORS

[75] Inventor: Miguel A. Tarrega, Barcelona, Spain

[73] Assignee: Klein Iberica S.A, Spain

[21] Appl. No.: 216,161

[22] Filed: Mar. 22, 1994

[30] Foreign Application Priority Data

Mar. 26, 1993 [ES] Spain ..... 9300632

[51] Int. Cl.[6] ..... E05D 15/06

[52] U.S. Cl. ..... 49/411; 49/409

[58] Field of Search ..... 49/410, 411, 409, 404; 52/207

[56] References Cited

U.S. PATENT DOCUMENTS

| | | | |
|---|---|---|---|
| 2,754,535 | 7/1956 | Plemeng | 49/411 X |
| 4,404,770 | 9/1983 | Markus | 49/409 X |
| 4,872,287 | 10/1989 | Block | 49/409 X |
| 5,172,518 | 12/1992 | Yoshino | 49/409 X |

FOREIGN PATENT DOCUMENTS

| | | | |
|---|---|---|---|
| 286673 | 12/1966 | Australia | 49/410 |
| 523382 | 8/1992 | Australia . | |
| 510641 | 4/1952 | Belgium | 49/409 |
| 0385045 | 8/1989 | European Pat. Off. . | |
| 2631072 | 5/1988 | France . | |
| 2836812 | 3/1980 | Germany . | |
| 3238204 | 4/1984 | Germany . | |
| 3837813 | 5/1990 | Germany . | |
| 1201799 | 8/1970 | United Kingdom | 49/410 |

*Primary Examiner*—Philip C. Kannan
*Attorney, Agent, or Firm*—Ostrolenk, Faber, Gerb & Soffen

[57] ABSTRACT

A mechanism for assembling sliding glass doors, comprising an upper track (3), a lower parallel guide (5) between which are arranged fixed sheets (1) and moveable sheets (2). The track (3) has an inverted L-shaped cross section and its vertical member is provided with means (16) for fastening stops, the lower part of said member ending in an inverted groove (14) with an upper rib (15) on which slides the wheel (30) of the suspension heads which comprise two plates (20 and 21) that can be opposed and fixed together, with the interposition of a pivot (27) to regulate the separation between said plates. The horizontal member (8) of the L-shape is provided at the end with a channel (18) for fixing a shape (19) to restricts the lifting of the sheet (2).

8 Claims, 6 Drawing Sheets

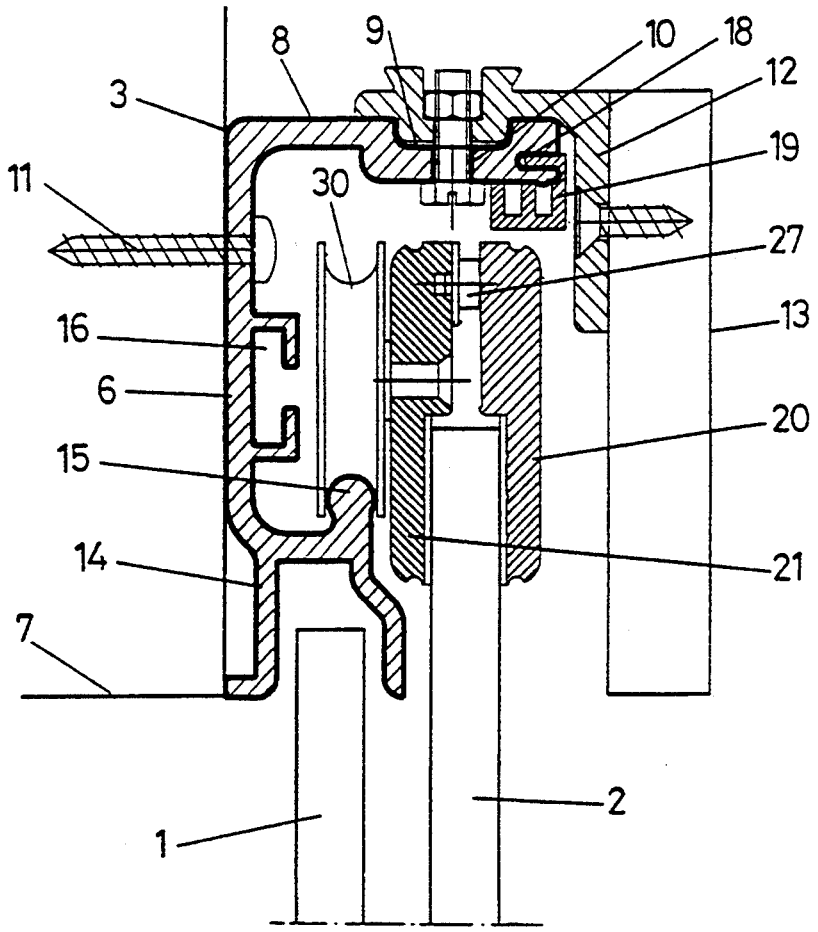
FIG. 1
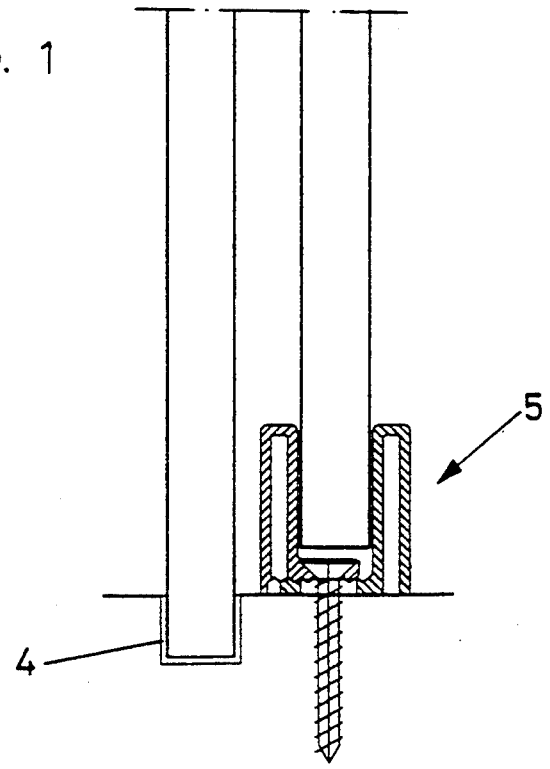

FIG. 4
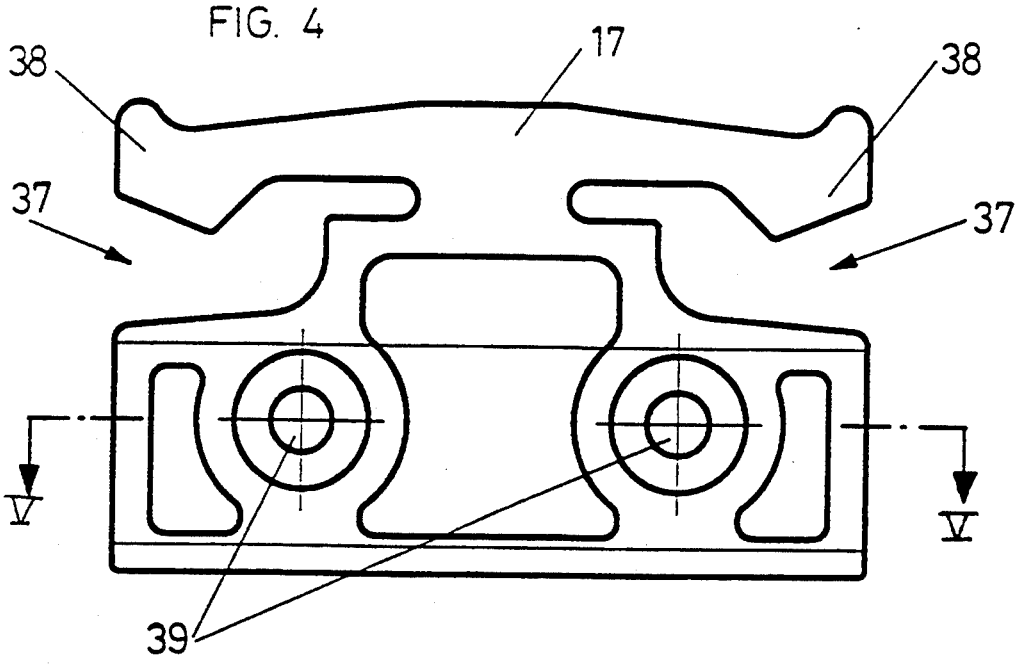
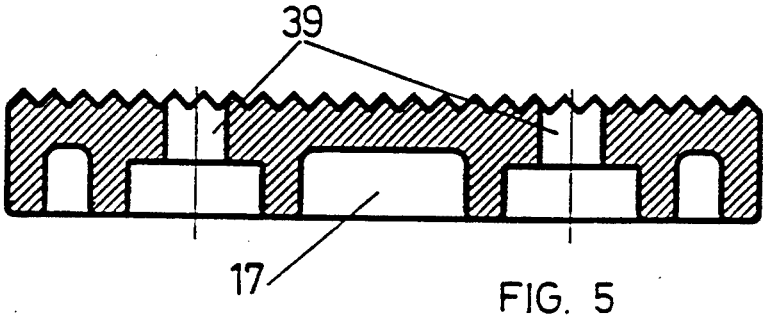
FIG. 5

FIG. 9
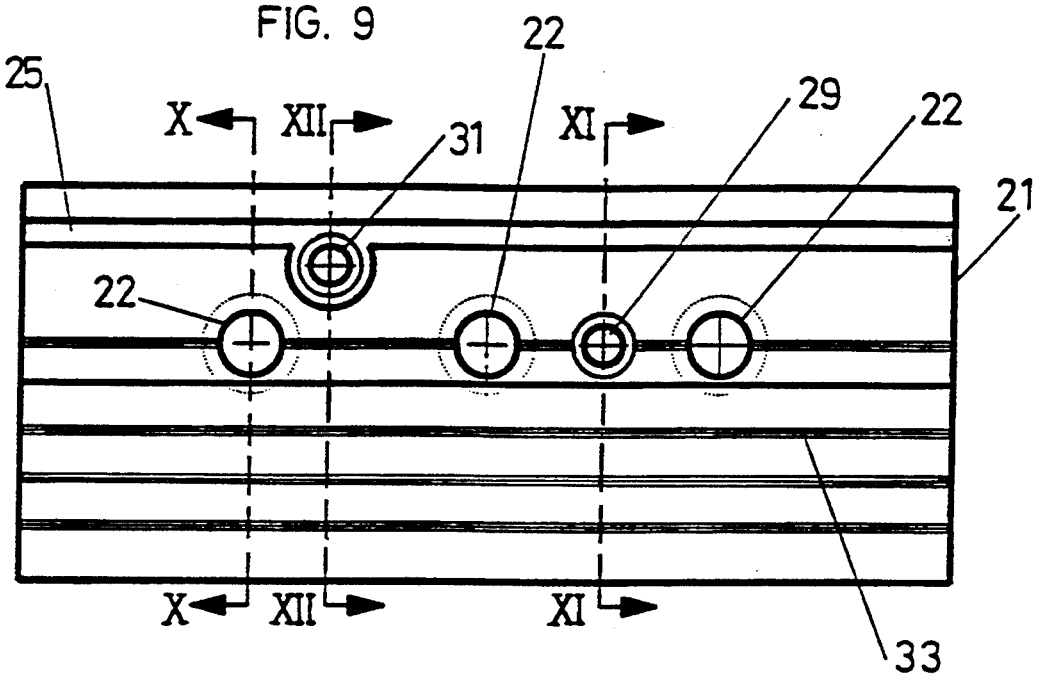
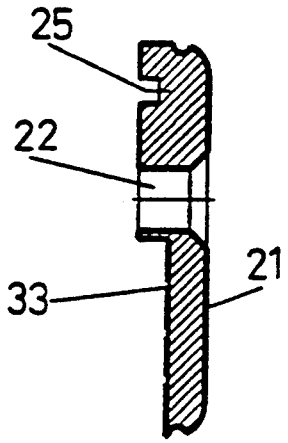
FIG. 10
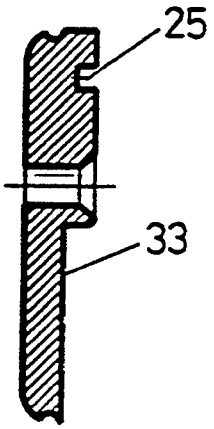
FIG. 11
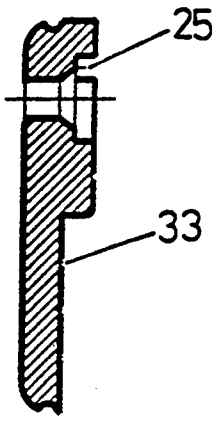
FIG. 12

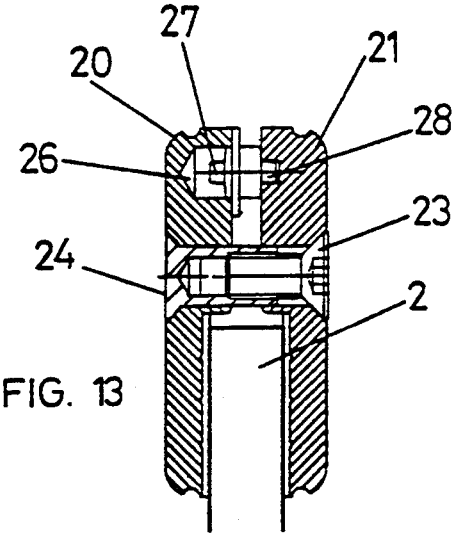
FIG. 13
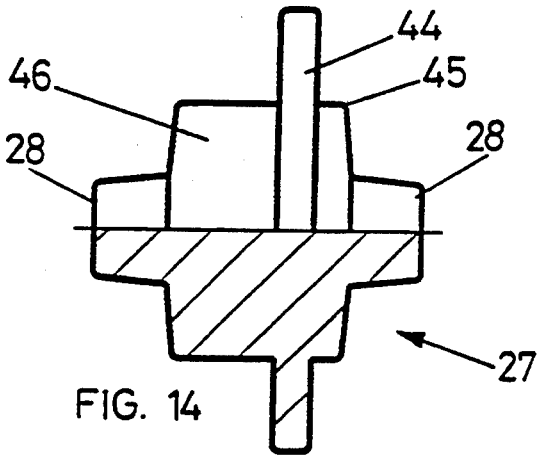
FIG. 14
FIG. 15
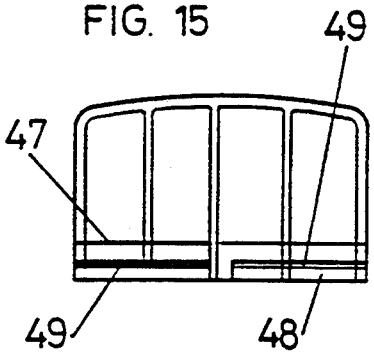
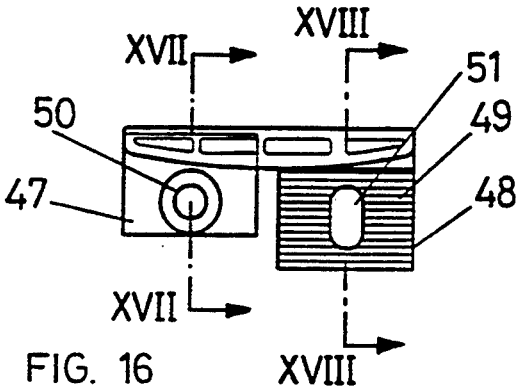
FIG. 16
FIG. 17
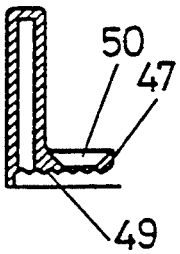
FIG. 18
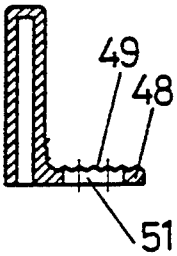

MECHANISM FOR SLIDING GLASS DOORS

The present invention relates to a mechanism for sliding glass doors, with or without integral partitions, which can be installed without the having to carry out subsequent mechanization or tempering of the glass sheets.

BACKGROUND OF THE INVENTION

Known mechanisms for the assembly of sliding glass doors require the processing of the sheet or panel of glass in order to fasten certain parts to it, in general made of stainless steel, which are later used to secure suspension elements.

This processing requires the formation of rebates or holes in the sheets or panels of glass in a state which requires that said sheet be later subjected to a tempering or hardening treatment.

This whole process is relatively expensive and furthermore carries the risk of causing breakages in the areas between housings and holes due to the effect of blows, and even the breakage of the entire sheet in the case of tempered glass.

DESCRIPTION OF THE INVENTION

The object of the present invention is a mechanism which allows the sliding door to be assembled without having to carry out any operation or processing on the glass, thereby eliminating the process of preparing the sheets of glass and avoiding the risk of the breakage thereof.

In particular, the mechanism of the invention is of the type which comprises an upper track, a lower guide parallel to the upper track, suspension heads which can be fixed to the upper edge of the door and which are provided with bearing elements that can be moved along the upper track, and means for limiting the movements of said door.

The mechanism of the invention includes an upper track comprised in such a way that the various components of which the assembly is formed can be easily assembled. The mechanism of the invention also includes a suspension head comprised in such a way that it can be fixed to the sheet or panel of glass without having to carry out mechanization or special treatment operations on said panel.

According to the invention the upper track comprises an inverted L-shape, the vertical member of which ends, along its free edge, in an inverted groove which protrudes towards the internal surface of said member and which is provided on the external surface of its base with a longitudinal rib with a rounded profile, said rib defining the bearing surface for the wheels or pulleys of the suspension heads. The same vertical member of the L-shape is provided on its internal surface with fastening means for the retaining stops which limit the travel of the suspension heads, enabling the position of said stops to be adjusted as required. The horizontal member of the L-shape is provided on its external surface with a central channel with through holes in the base for fixing the track to the ceiling or for fitting a front cover. The same horizontal member is provided along its free edge with a slit for fixing a shape, the function of which is to restrict the lifting of the door to prevent it from accidentally coming free or disassembling itself. The vertical member of the L-shape is also provided with holes which enable said shape to be fixed to a wall.

According to the invention, the suspension heads comprise two approximately equal rectangular plates which can be opposed and fixed together in corresponding positions. Said plates are provided on their opposing, surfaces with longitudinal rebates beginning at the lower edge, said rebates, when the two plates are opposed, defining a slot which can be coupled to the upper edge of the door. The plates are also provided on their opposing surfaces with formations to which separators can be coupled, enabling the distance between the plates to be varied depending on the thickness of the glass of the door. Fitted to the external surface of one of the plates is one or more freely rotating wheels, the axis of said wheel or wheels being perpendicular to said plate, and a pivot designed to engage with the travel retaining stops fixed to the track.

This arrangement, together with other characteristics of the invention as described in the claims, can be more easily understood from the following description which, with reference to the accompanying drawings, represents by way of a non-limiting example one practical embodiment.

BRIEF DESCRIPTION OF THE DRAWINGS

In the drawings:

FIG. 1 is a vertical member of a sliding door fitted with the mechanism of the invention, taken across the plane which passes through the axis of one of the wheels on the suspension heads.

FIG. 4 is a front elevation view of one of the retaining stops which limit the travel of the doors.

FIG. 5 is a section of the retaining stop, taken across the line V—V of FIG. 4.

FIG. 9 is an internal view of the rear plate of one of the suspension heads.

FIGS. 10, 11 and 12 are cross sections of the rear plate taken across the lines X—X, XI—XI and XII—XII respectively.

FIG. 13 is a cross section of one of the suspension heads taken across the vertical plane which passes through one of the screws or elements which join the two plates to the head.

FIG. 14 is a large scale lateral view, sectioned at 45°, of one of the separators with which the suspension heads are fitted.

FIGS. 15 and 16 are, respectively, a front elevation view and a plan view of one of the parts which form the lower guides for the moveable sheets.

FIGS. 17 and 18 are sections taken across the lines XVII—XVII and XVIII—XVIII of FIG. 16.

DESCRIPTION OF A PREFERRED EMBODIMENT

Figure 2:
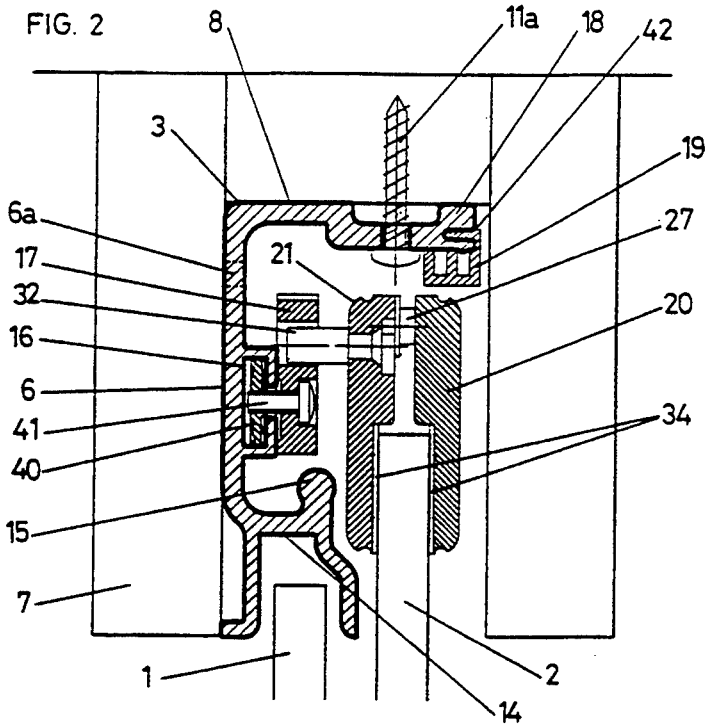
FIG. 2 is a section similar to FIG. 1 taken across a vertical plane which passes through the pivot which acts as a retaining stop for the suspension heads of the door.
Figure 3:
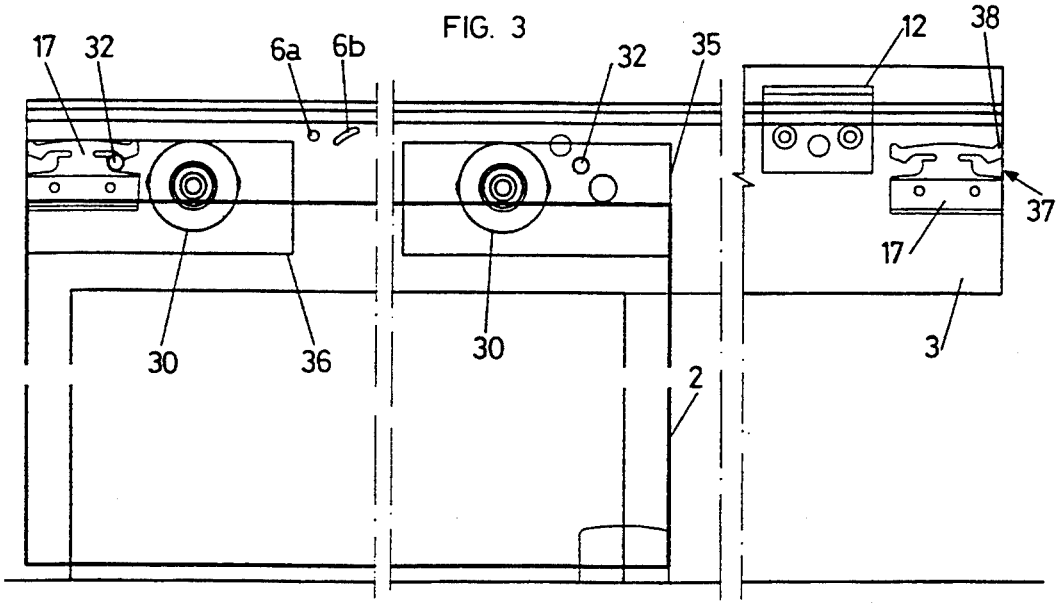
FIG. 3 is a schematic front elevation view of a sliding glass door fitted with the mechanism of the invention.
Figure 6:
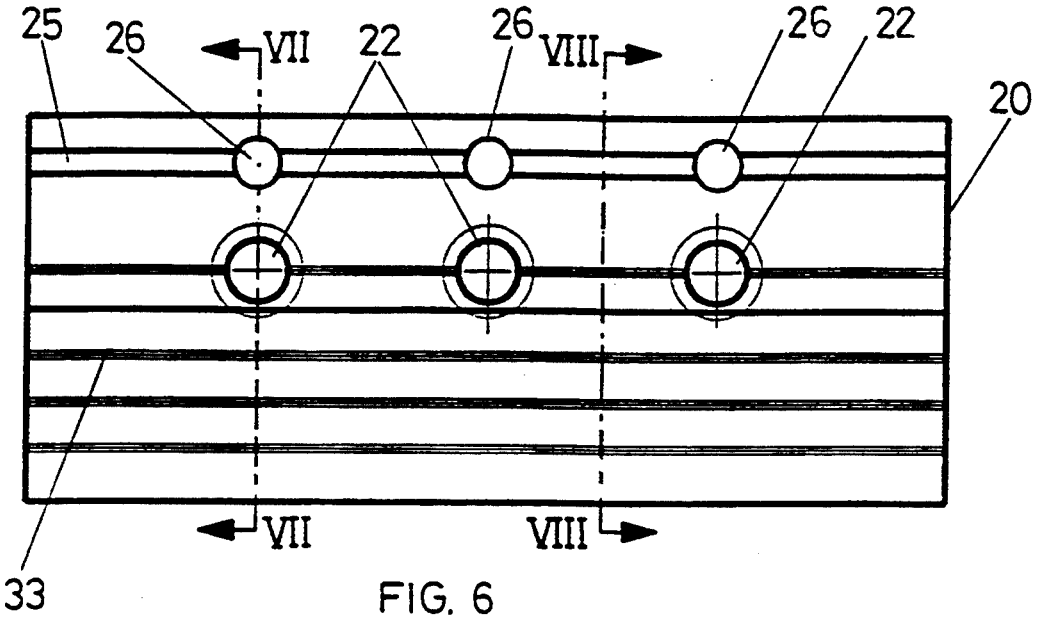
FIG. 6 is an internal view of the front plate of the suspension heads.
Figure 7:
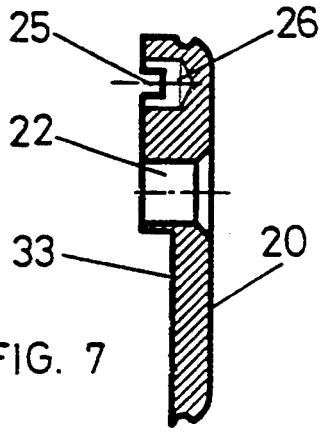
FIGS. 7 and 8 are sections of the front plate, taken across the lines VII—VII and VIII—VIII respectively of FIG. 6.
Figure 8:
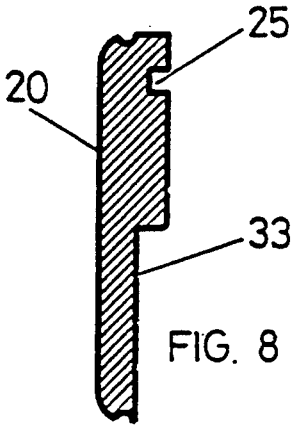

The assembly shown in FIGS. 1 to 3 represents a door which includes two glass sheets, one which is fixed, indicated by the number 1, and another which slides, indicated by the number 2. These two sheets are assembled between an upper track, indicated by the number 3, and a lower track 4 for the fixed sheet and a guide 5 for the sliding sheet 2.

The track 3 comprises a part which is approximately L-shaped in section in an inverted position, the external surface of its major member 6 opposing the upper front part 7 of the gap which the doors are designed to close. The other member of the track 3, indicated by the number 8, projects horizontally outwards and is provided on its external surface with a longitudinal channel 9 provided with through holes 10 in the base.

The track 3 may be secured by means of the vertical member 6 using screws 11 as shown in FIG. 1, or by means of the horizontal member 8 using screws 11*a* as shown in FIG. 2. The vertical member 6 may be provided with round holes 6a and elongated holes 6*b* (FIG. 3) which are obliquely positioned, said holes possibly alternating with circular holes and being provided for passing the screws 11. Said elongated, oblique holes enable the track 3, and therefore the sheet 2, to be adjusted vertically if necessary.

An auxiliary part 12 may be provided on the external channel 9 of the horizontal member 8 (FIG. 1) for fixing a cover 13 to hide the mechanism.

The free edge of the vertical member 6 ends in an inverted groove 14 which protrudes towards the internal surface of said member 6. The upper edge of the fixed sheet 1 of the door is located in the groove 14. The base of the groove 14 is provided externally with a longitudinal rib 15 with a rounded profile.

The vertical member 6 of the track 3 is further provided on its internal surface with a longitudinal slot 16 for fixing retaining stops 17 (FIG. 2) the function of which is to limit the travel of the moveable sheet 2.

The horizontal member 8 of the track is provided along its free edge with a slit 18 for fixing a shape 19 which acts as a stop against the lifting of the moveable sheet 2.

The moveable sheet is fitted by means of suspension heads which are fixed to the upper edge of said sheet. According to the present invention, these heads comprise two approximately equal plates, indicated by the numbers 20 and 21, approximately rectangular in shape, opposing each other and joined together in corresponding positions. The configuration of these plates is described below with reference to FIGS. 6 to 12.

The two plates 20 and 21 are each provided with longitudinal rows of opposable holes 22 which are arranged as shown in FIG. 13 to receive threaded nuts 24 and bolts 23 which act as fixing elements for the two plates and which are completely housed within said plates.

The two plates are also each provided on their internal surfaces with longitudinal grooves 25 situated in opposing positions above the rows of holes 22. The front plate 20 is provided with blind holes 26 in a corresponding position to that of said channel and in which separators 27 can be fitted (FIGS. 1, 13 and 14) in the form of cylindrical nuclei, a central pivot 28 protruding axially from the bases of said separators for locating in the channel 25 of the opposing plate 21.

As can be seen in FIGS. 9 to 12, the rear plate is provided with one or more through holes 29 situated approximately at the level of the holes 22 and designed for fixing a freely rotating wheel 30 (FIG. 1) with a peripheral groove, the shape of which is adapted to the rib 15 of the track 3. With this system the wheel or wheels 30 are housed within the shape of the track 3, eliminating the distance between said shape and the sheet 2 of Glass which exists in traditional mechanisms. In this way, once the whole mechanism has been assembled, only the sheet or sheets of the door and the upper cover 13 are visible.

Finally, the rear plate 21 is provided with a through hole 31 in which a pivot 32 is fitted from the external surface of said plate, said pivot backing up to and fixing to the retaining stops 17 which are fastened to the track 3 to limit the travel of the moveable door 2.

The two plates 20 and 21 are also each provided on their opposable surfaces and starting from their lower edges with longitudinal rebates 33 which, when the two plates are opposed and joined, define a slot which can be coupled to the upper edge of the sheet 2. The opposing surfaces of these rebates 33 may be provided with ribs or grooves, With this arrangement the suspension heads act like pliers, the jaws of which are defined by the opposing surfaces of the rebates 33. As the threaded nuts 24 and bolts 23 which join the two plates are tightened, and by means of the Grip defined by the intermediate separators 27, said jaws are made to press on the surfaces of the sheet 2 of glass. To achieve a better grip, sheets 34 of an elastically deformable material may be interposed between the surfaces of the rebates or jaws 33 and the sheet 2.

As can seen in FIGS. 1 and 2, the shape 19 fixed to the edge of the horizontal member 8 of the track acts as a stop for the suspension heads, preventing the door from lifting and coming out of the track.

FIG. 3 shows schematically a moveable sheet which is suspended by two heads 35 and 36, each of which includes a wheel 30. These heads may include two or more wheels. In any case, the heads 35 and 36 are fixed to the sheet 2 at the vertical edges thereof. FIG. 3 shows schematically the track 3 at the ends of which the stops 17 are fixed to limit the travel of the sheet 2 each time that the pivot 32 of one of the heads reaches the stop 17.

FIGS. 4 and 5 show the arrangement of these retaining stops which are in the form of approximately rectangular plates and provided starting from their shorter edges with notches 37 which limit external lugs 38 whose internal shape retains the pivot 32 of the suspension heads. When the sheet 2 reaches its end positions, the pivot 32 locates in the opposing groove 37 such that the pivot is elastically retained by the internal shape of the lug 38, as can be seen in FIG. 3. The internal surface of the plates which constitute the retaining stops 17 is toothed or serrated, as can be seen in FIG. 5. These plates are provided with holes 39 through which pass screws for fixing them to the plates 40 (FIG. 2) which are located inside the longitudinal slot 16 in the track 3 and along which they can be moved. These plates are provided with deformations which define teeth for fastening against the front walls of the slot 16 when the securing screws 41 of the retaining stops 17 are tightened.

As can be seen in FIGS. 1 and 2, the shape 19 which is fixed to the edge of the horizontal member 8 of the track includes a section 42 which can be introduced into a slit 18 in the member 8 and that it is this shape 19 which defines the stop that prevents the moveable door from lifting.

The mechanism of the invention is easy to assemble and does not require that mechanization or treatment operations be carried out on the sheets of glass, thereby eliminating the risk of breakages both at the time of assembly and during the use of the door, and moreover reducing the assembly costs.

With the mechanism of the invention it is possible to assemble doors opposing a wall, fixed to the ceiling, inside a false ceiling, etc. Furthermore, the mechanism of the invention can be applied to the assembly of doors with one or more coplanar sliding sheets, alone or combined with fixed parallel sheets which form a fixed partition.

As can be seen in FIGS. 13 and 14, the separators 27 in the form of cylindrical nuclei are provided with a peripheral wing 44 the diameter of which is greater than that of the blind holes 26 and the width of the grooves 25. This wing 44 is moved axially towards one of the pivots 28 to vary the separation between the plates 20 and 21 which form the heads, thereby adjusting it to suit different thickness of the glass sheet 2. In the position shown in FIG. 13 the separators 27 keep the plates 20 and 21 at maximum separation when the shorter section 45 of the nucleus is introduced into the hole 26. However, if the separator is inverted the longer section 46 is the one which enters the hole 26 and the distance between the plates 20 and 21 will be less.

The lower guide 5 comprises two equal parts, one of which is shown in FIGS. 15 to 18.

This part is L-shaped, with the horizontal member subdivided into two sections 47 and 48 of different lengths and situated at different heights, such that when the parts are positioned facing each other, the upper section 47 of each part opposes the lower section 48 of the other part. These section are provided on their opposable surfaces with transverse serrations 49 to ensure that the relative position of the two parts of which the guide is formed is maintained, said pieces being fixed by means of screws which are introduced through the holes 50 and 51 in each part and facing each other. The hole 51 is oblong to enable the orientation of the guide to be adjusted.

With the arrangement described it is possible to vary the separation between the vertical members of the two parts and thereby vary the width of the guide 5 (FIG. 1) to adjust it to suit different thicknesses of the sheet of glass 2.

As can be seen in FIG. 1, the wheel 30 has a concave shape and the rib 15 is convex, the two shapes corresponding. With this arrangement the sheet of glass 2 has a certain amount of freedom of transverse pendular movement, without having to provide the heads with pivots, thereby avoiding the risk of transmitting harmful bending forces to the sheet of glass.

I claim:

1. A mechanism for mounting a sliding glass door, comprising:

an upper track, a lower guide parallel to the upper track, suspension heads fixed to an upper edge of the door and provided with bearing elements that can be moved along the upper track, and means for limiting movement of the door, wherein the upper track comprises an inverted L-shape, a vertical member of which is provided on its internal surface with means for fastening travel stops which restrict horizontal travel of the door, the vertical member ending, along its free edge, in an inverted groove which protrudes towards the internal surface of the vertical member, the groove being provided externally with a longitudinal rib with a rounded profile, a horizontal member of the L-shape being provided with a central external channel with through holes, and a slit along its free edge for securing a vertical lifting stop, the function of which is to restrict lifting of the door, and wherein the suspension heads comprise two approximately equal rectangular plates which are opposed to one another and fixed together in corresponding positions, the plates being provided on their opposing surfaces with longitudinal rebates, beginning at a lower edge of the plates, the rebates defining a slot that can be coupled to the upper edge of the door, one of the plates being fitted on its external surface with at least one freely rotating wheel, the at least one wheel having an axis of rotation which is perpendicular to the plate, and the plate being fitted with a pivot designed to engage against the travel stops, the at least one wheel being supported by the longitudinal rib on the inverted groove in which the lower edge of the track ends.

2. A mechanism according to claim 1, wherein the means for fastening the retaining stops comprises a slot which runs along the internal surface of the vertical member of the track, the slot being provided with a longitudinal central opening, and wherein securing plates provided with threaded holes are located in the slot, and wherein the travel stops are fixed to the securing plates by means of screws which pass through the longitudinal central opening in the slot.

3. A mechanism according to claim 1, wherein the lifting stop which restricts lifting of the door comprises a wing introduced into the slit in the edge of the horizontal member of the track, and a body situated below the horizontal member and forming a longitudinal stop.

4. A mechanism according to claim 1, wherein the two plates which form the suspension heads are each provided above the longitudinal rebates with intermediate rows of holes designed to receive threaded fixing nuts and bolts, the heads including separating nuclei situated between the two plates and above the rows of holes, the nuclei being partially introduced into blind opposing housings which are provided on the opposing surfaces of the plates.

5. A mechanism according to claim 4, wherein the housings consist of at least two longitudinally aligned blind holes in the opposing surface of one of the plates, and a longitudinal channel which opposes the holes situated in the opposing surface of the opposite plate.

6. A mechanism according to claim 5, wherein each of the separating nuclei comprise a cylinder having the diameter of the cylinder being approximately equal to that of the blind holes, the separating nuclei being provided with a peripheral wing axially displaced relative to a mid transverse plane and defining two sections of different lengths, wherein coaxial pivots protrude from the two sections, the pivots having diameters which are approximately equal to the width of the longitudinal channel.

7. A mechanism according to claim 4, wherein each of the separating nuclei comprise a cylinder, the diameter of the cylinder being approximately equal to that of the blind holes, the separating nuclei being provided with a peripheral wing axially displaced relative to a mid transverse plane and defining two sections of different lengths, wherein coaxial pivots protrude from the two sections, the pivots having diameters which are approximately equal to the width of the longitudinal channel.

8. A mechanism according to claim 1, wherein the lower guide is formed of grooved elements, each of the grooved elements comprising two equal L-pieces, the L-pieces having horizontal members subdivided into two sections of different lengths, situated at different heights and each provided with holes, one of the holes being oblong, the two L-pieces being coupled together in an opposing position with the sections of the horizontal members superimposed and the holes thereof opposing each other, the opposable surfaces of the sections being provided with transverse ribs.

* * * * *